United States Patent [19]

Sawada et al.

[11] Patent Number: 4,812,735

[45] Date of Patent: Mar. 14, 1989

[54] INTERMEDIATE POTENTIAL GENERATING CIRCUIT

[75] Inventors: Kazuhiro Sawada, Yokohama; Takayasu Sakurai, Tokyo, both of Japan

[73] Assignee: Kabushiki Kaisha Toshiba, Kanakawa, Japan

[21] Appl. No.: 138,798

[22] Filed: Dec. 28, 1987

[30] Foreign Application Priority Data

Jan. 14, 1987 [JP] Japan ..... 62-5108

[51] Int. Cl.[4] ..... G05F 3/30

[52] U.S. Cl. ..... 323/313; 307/297

[58] Field of Search ..... 323/313, 314, 315, 316; 307/296 R, 297

[56] References Cited

U.S. PATENT DOCUMENTS

| | | | |
|---|---|---|---|
| 4,100,437 | 7/1978 | Hoff, Jr. | 323/314 |
| 4,128,816 | 12/1978 | Shimotsuma | 323/313 |
| 4,300,061 | 11/1981 | Mihalich et al. | 323/313 |
| 4,347,476 | 8/1982 | Tam | 323/313 |
| 4,375,596 | 3/1983 | Hoshi | 323/313 |
| 4,675,557 | 6/1987 | Huntington | 323/314 |

FOREIGN PATENT DOCUMENTS

EP-O-205104 of 0000 European Pat. Off. .

59-157727A of 0000 Japan .

*Primary Examiner*—Peter S. Wong

*Attorney, Agent, or Firm*—Finnegan, Henderson, Farabow, Garrett, & Dunner

[57] ABSTRACT

This invention provides an intermediate potential generating circuit comprising a load element of which one end is connected to a first potential supply source, a first transistor of a first conductivity type of which one end and the gate thereof are connected to the other end of the load element, a second transistor of a second conductivity type of which one end is connected to the other end of the first transistor, and the gate and the other end thereof are connected together, a constant-voltage means connected between the other end of the second transistor and a second potential supply source for causing a specific voltage drop between the ends of the contant-voltage means, a third transistor of the first conductivity type of which one end is connected to the first potential supply source, the gate is connected to a node between the load element and the first transistor, and the other end thereof is connected to an output terminal, and a fourth transistor of the second conductivity type which is connected between the output terminal and the second supply source and of which the gate is connected to a node between the second transistor and the constant-voltage means.

7 Claims, 2 Drawing Sheets

INTERMEDIATE POTENTIAL GENERATING CIRCUIT

BACKGROUND OF THE INVENTION

1. Field of the Invention

This invention relates to an intermediate potential generating circuit, formed in a semiconductor integrated circuit, which produces an intermediate potential from the power source voltage applied to the device.

2. Description of the Related Art

As the scale of semiconductor integrated circuit devices has become larger in recent years, intermediate potential generating circuits with large current driving capabilities but small power consumption have come to be required.

Thus, an intermediate potential generating circuit such as that shown in FIG. 1 has been conceived. This related art circuit is described in the Specification of Japanese Application (Showa) No. 60-125670.

The construction of the intermediate potential generating cirucit shown in FIG. 1 is as follows. First, two types of intermediate potential are generated by high resistance elements R1 and R2, N-channel type MOS trannsistor Q1 and P-channel type MOS transistor Q2. These two types of intermediate potential are respectively supplied to the gates of N-channel type MOS transistor Q3 and P-channel type MOS transistor Q4. Transistor Q3 and Q4 have large current drive capabilities and are connected in series between the power sources $V_{DD}$ and $V_{SS}$. Then, an intermediate potential is obtained from the node between transistors Q3 and Q4.

Here, if the threshold voltages of N-channel type MOS transistors Q1 and Q3 are taken as $V_{tn1}$ and $V_{tn3}$ and the threshold voltages of P-channel type MOS transistors Q2 and Q4 are taken as $V_{tp2}$ and $V_{tp4}$, the relationship $$V_{tn1}+|V_{tp2}|<V_{tn3}+|V_{tp4}|$$

must be satisfied in order to prevent a through current flowing between power source $V_{DD}$ and ground power source $V_{SS}$. However, it is difficult to achieve the above kind of threshold value relationship without increasing the complexity of the production processes.

In order to solve this problem, an intermediate potential generating circuit is described in the Specification of Japanese Patent Application (Showa) No. 61-65142. In this intermediate potential generating circuit, the back gate of N-channel type MOS transistor Q1 is connected to the node n3 between transistor Q1 and Q2. By doing this, since the threshold voltage of transistor Q1 is lowered by the substrate bias effect, it becomes possible to satisfy the threshold value relationship given without increasing the difficulty of the production processes. Moreover, in this FIG., the case of high resistance elements R1 and R2 being replaced by P-channel type MOS transistor Q5 and N-channel type MOS transistor Q6 is shown. In this arrangement, the channel lengths of transistors Q5 and Q6 are made longer than normal and their channel widths are made narrower than normal.

In this way, by using the configurations shown in FIGS. 1 and 2, intermediate potential generating circuits can be obtained with high current driving capability but low power consumption. However, their outputs, that is to say their intermediate potentials, are greatly influenced by the fluctuation of power source $V_{DD}$, as shown in FIG. 3.

In FIG. 3, $V_{n1}$ is the potential of node n1 to which the gate of transistor Q3 is connected, $V_{n2}$ is the potential of node n2 to which the gate of transistor Q4 is connected, $V_{n3}$ is the potential of node n3 between transistors Q1 and Q2, and $V_{out}$ is the potential of the node between transistors Q3 and Q4, that is to say the output potential.

As can be seen from this FIG., if power source $V_{DD}$ varies from 3[V] to 7[V], the output potential $V_{out}$ which is set at 1.5[V] when power source $V_{DD}$ is 3[V], varies from 1.5[V] according to the variation of power source $V_{DD}$.

An intermediate potential is normally used as the plate voltage for memory cells constructed of capacitors in order to prevent insulation breakdown. However, in cases such as in FIG. 3 where the output of the intermediate potential generating circuit depends largely on the fluctuation of power source $V_{DD}$, there are times when the cell data can be destroyed by this fluctuation. This is caused by the fact that when, for example, the potential of power source $V_{DD}$ is greatly reduced by noise or the like, the potential of the N-type diffusion layer which forms the memory node of the capacitor also reduces due to coupling, this in turn causes the PN junction between the N-type diffusion layer and the P-type diffusion layer to generate a forward bias.

SUMMARY OF THE INVENTION

An object of this invention is to provide an intermediate potential generating circuit which can obtain a suitable output, which does not depend on the fluctuation of the power source potential and which has a low power consumption and a large current driving capacity. This is in contrast to conventional intermediate potential generating circuits in which the output potential is greatly influenced by fluctuations of the power source potential.

This invention provides an intermediate potential generating circuit comprising, a load element of which one end is connected to a first potential supply source, a first transistor of a first conductivity type of which one end and the gate thereof are connected to the other end of the load element, a second transistor of a second conductivity type of which one end is connected to the other end of the first transistor and the gate and the other end thereof are connected together, a constant-voltage means connected between the other end of the second transistor and a second potential supply source for causing a specified voltage drop between the ends of the constant voltage means, a third transistor of the first conductivity type of which one end is connected to the first potential supply source, the gate is connected to a node between the load element and the first transistor, and the other end further is connected to an output terminal, and a fourth transistor of the second conductivity type which is connected between the output terminal and the second supply source and of which the gate is connected to a node between the second transistor and the constant-voltage means.

In an intermediate potential generating circuit constructed in accordance with an embodiment of the present invention, two types of intermediate potential with small current driving capabilities are generated by; the load element, the first and second transistors and the constant-voltage means. These two types of intermediate potential are respectively supplied to the gates of the third and fourth transistors which have large current capabilities and are connected in series between the first potential supply source and the second potential supply source. In this case, by using the constant-voltage element, even if the potential of the first or second potential supply source fluctuates, the fluctuation of the potentials supplied respectively to the gate of the third and fourth transistors can be controlled. Consequently, it is possible to generate a stable intermediate potential which does not depend on the fluctuation of the power source.

BRIEF DESCRIPTION OF THE DRAWINGS

Embodiments of this invention will now be described by way of example only and with reference to the accompanying drawings, in which.

DETAILED DESCRIPTION OF THE PREFERRED EMBODIMENTS

An embodiment of the present invention which uses a semiconductor construction with a P-type well region formed in an N-type semiconductor substrate will now be explained, with reference to the accompanying drawings.

Figure 1:
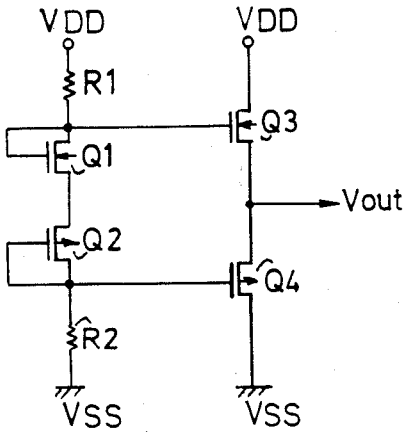
FIG. 1. PRIOR ART
FIGS. 1 and 2 are each circuit construction drawings to explain conventional intermediate potential generating circuits.
Figure 2:
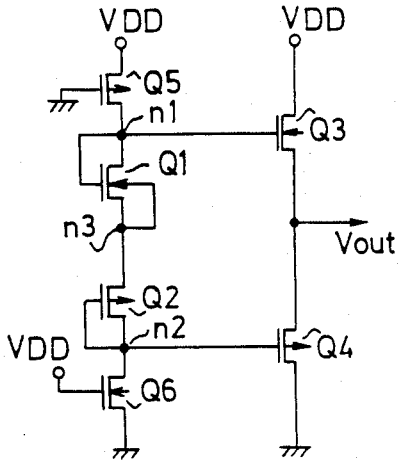
FIG. 2. PRIOR ART
Figure 3:
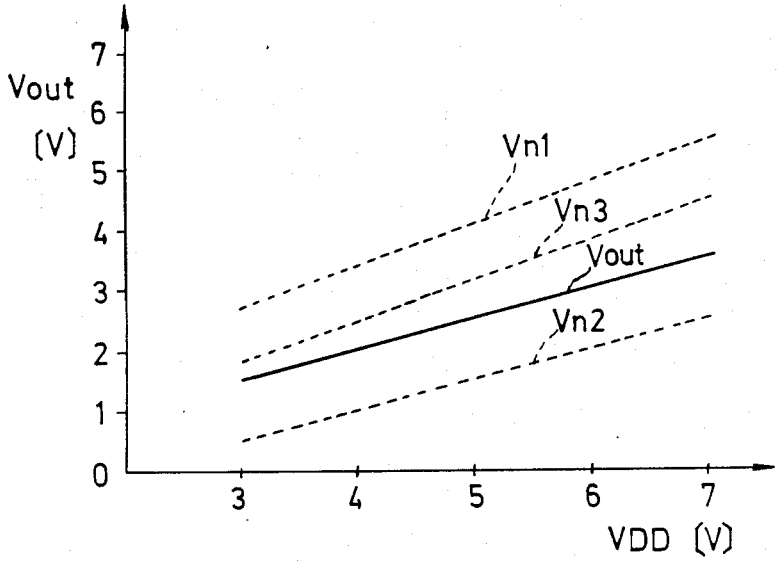
FIG. 3. PRIOR ART
FIG. 3 is a graph showing the variation of the output potential in a conventional intermediate potential generating circuit.
Figure 4:
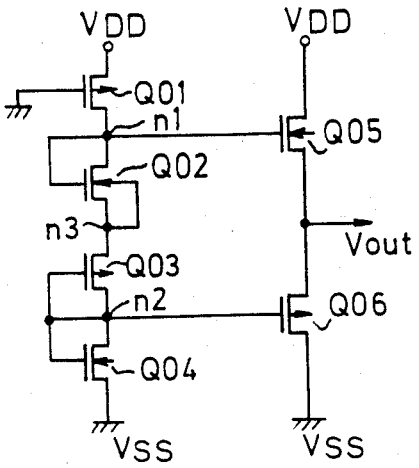
FIG. 4 is a circuit diagram of an intermediate potential generating circuit which forms an embodiment of the present invention.

FIG. 4 shows an intermediate potential generating circuit in accordance with a first embodiment of this invention. P-channel MOS transistor Q01, N-channel MOS transistor Q02, P-channel MOS transistor Q03 and N-channel MOS transistors Q04, each having a small current driving capacity, are connected in series between potential source $V_{DD}$ and ground power source $V_{SS}$.

P-channel MOS transistor Q01 acts as a load, since its channel length is set long and its channel width narrow; also its gate is connected to ground potential source $V_{SS}$ so that it is always set in the ON state. Moreover, node n1 between transistor Q02 and transistor Q01 is connected to the gate of transistor Q02, and the back gate of transistor Q02 is connected to node n3 between transistors Q02 and transistor Q03. The gates of transistors Q03 and Q04 are interconnected and connected to node n2 which is at the series connection junction of the two transistors. Consequently, transistor Q04 operates to maintain the potential of node n2 constant, by acting in the same way as a diode.

The gate of an N-channel type MOS transistor Q05, which transistor has one terminal connected to the $V_{DD}$ power source, is connected to node n1. The gate of a P-channel type MOS transistors Q06, which transistor is inserted between transistor Q05 and the ground potential source $V_{SS}$, is connected to node n2. Thus, the potential of the node between transistors Q05 and Q06 becomes the output potential $V_{out}$ of this intermediate potential generating circuit.

In this kind of intermediate potential generating circuit, by setting each of the channel widths of transistors Q05 and Q06 to be wider than the channel width used in transistors Q01, Q02, Q03 and Q04, transistors Q05 and Q06 will have large current driving capacities.

Moreover, if the threshold voltage of N-channel type MOS transistor Q02 is taken as $V_{tn2}$, the threshold voltage of P-channel type MOS transistors Q03 is taken as $V_{tp3}$, the threshold voltage of N-channel type MOS transistor Q05 is taken as $V_{tn5}$, and the threshold voltage of P-channel type MOS transistor Q06 is taken as $V_{tp6}$, the relationship $$V_{tn2}+|V_{tp3}|<V_{tn5}+|V_{tp6}|$$

is established between these threshold voltages. Since this kind of relationship is established, transistors Q05 and Q06 will not be ON at the same time, the flow of a through current from power source $V_{DD}$ to ground potential source $V_{SS}$ can be prevented and production of low power consumption becomes possible.

As mentioned above, even if power source $V_{DD}$ fluctuates, the potential of node n2 is an almost constant value. That is to say, it is maintained at almost the threshold voltage $V_{tn4}$ of transistor Q04. Consequently, for example, the potential rise of node n1 which accompanies the potential rise of power source $V_{DD}$ is controlled. As a result, output potential $V_{out}$ becomes a stable value, as shown in FIG. 5, and does not depend on the fluctuation of power source $V_{DD}$.

Figure 5:
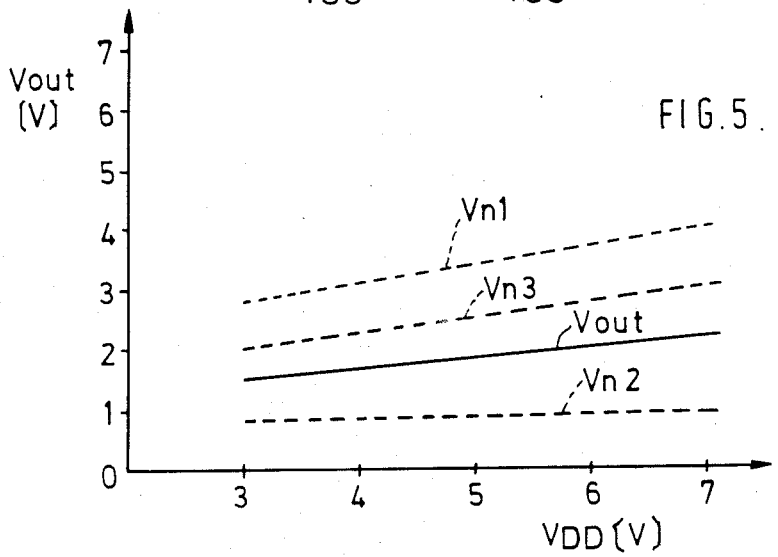
FIG. 5 is a graph showing the variation of the output potential of the intermediate potential generating circuit of FIG. 4.

FIG. 5 shows the fluctuation of potentials $V_{n1}$, $V_{n2}$ and $V_{n3}$ at nodes n1, n2 and n3 and output potential $V_{out}$ where power source $V_{DD}$ varies from 3[V] to 7[V]. Even though power source $V_{DD}$ fluctuates from 3[V] to 7[V], the output potential $V_{out}$, which is set at 1.5[V] when power source $V_{DD}$ is 3[V], only increases to about 2.2[V]. The increase which would be 130% or more in a conventional circuit can be controlled to an increase of 50% or less.

Consequently, if an intermediate potential generating circuit constructed in this way is used for the plate voltage supply of memory cells, the destruction of the memory cell data as mentioned above can be prevented.

In the above described circuit, the threshold voltage of transistor Q02 is reduced by connecting the back gate of transistor Q02 to node n3 between transistor Q02 and transistor Q03. However, since it is only important to satisfy the relationship $$V_{tn2}+|V_{tp3}|<V_{tn5}+|V_{tp6}|$$

is may also be satisfied, without using this kind of substrate bias effect, by setting the degree of impurity of the channel regions or by setting the channel lengths of transistors Q02, Q03, Q04 and Q05.

Figure 6:
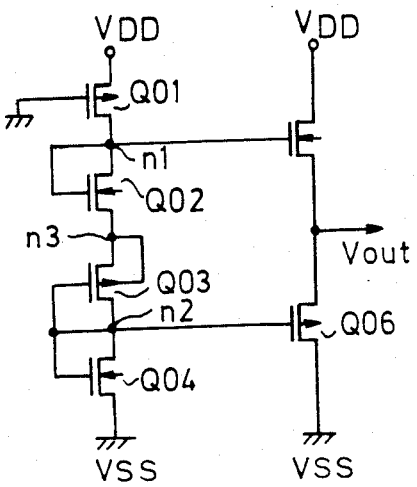
FIG. 6 is a circuit diagram of an intermediate potential generating circuit which forms a second embodiment of the present invention.

As shown in FIG. 6, it is also possible to satisfy this kind of threshold value relationship by using a construction in which an N-type well region is formed in a P-type semiconductor substrate, even though the back gate of P-channel type MOS transistor Q03 is connected to node n3 at the point of series connection of transistors Q02 and Q03.

Figure 7:
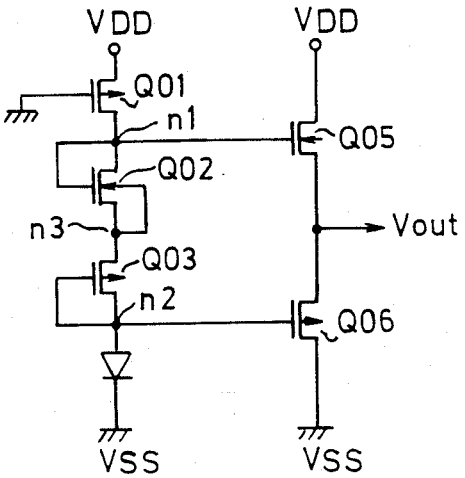
FIG. 7 is a circuit construction drawing related to a further embodiment of this invention.

As shown in FIG. 7, although transistor Q04 is designated to act as a constant-voltage element in the above described embodiments, it is also possible to use a PN junction diode in place of transistors Q04.

Furthermore, it is also possible to substitute a resistor element formed from, for example, polysilicon or the like for transistor Q01.

By implementing the present invention in the above described manner, it becomes possible to provide an intermediate potential generating circuit having a stable output potential independent of power source fluctuations.

As will be readily apparent to those skilled in the art, various modifications can be made to the described embodiments without departing from the scope of the invention.

What is claimed is:

1. An intermediate potential generating circuit comprising:

a load element having a first end thereof connected to a first potential supply source, a first transistor of a first conductivity type having a first end thereof and a gate thereof connected to a second end of said load element, a second transistor of a second conductivity type having a first end thereof connected to a second end of said first transistor, and having a gate and a second end thereof connected together;

a third transistor of said first conductivity type having a first end thereof connected to said first potential supply source, a gate thereof connected to a node between said load element and said first transistor and a second end thereof connected to an output terminal;

a fourth transistor of said second conductivity type connected between said output terminal and a second potential supply source and having a gate thereof connected to said gate and said second end of said second transistor; and a constant-voltage means connected between said second end of said second transistor and said second potential supply source for causing a specified voltage drop between the ends of said constant voltage means.

2. An intermediate potential generating circuit as claimed in claim 1, wherein the sum of a threshold voltage of said first transistor and the absolute value of a threshold voltage of said second transistor is less than the sum of a threshold voltage of said third transistor and the absolute value of a threshold voltage of said fourth transistor.

3. An intermediate potential generating circuit as claimed in claim 1, wherein said first transistor includes a back gate connected to a node between said first transistor and said second transistor.

4. An intermediate potential generating circuit as claimed in claim 1, wherein said second transistor includes a back gate connected to a node between said first transistor and said second transistor.

5. An intermediate potential generating circuit as claimed in claim 1, wherein said constant-voltage means comprises a fifth transistor of said first conductivity type.

6. An intermediate potential generating circuit as claimed in claim 1, wherein said constant-voltage means comprises a diode.

7. An intermediate potential generating circuit as claimed in claim 1, wherein said load element comprises a resistor.

* * * * *